US007419018B2

(12) United States Patent
Hall et al.

(10) Patent No.: US 7,419,018 B2
(45) Date of Patent: Sep. 2, 2008

(54) CAM ASSEMBLY IN A DOWNHOLE COMPONENT

(76) Inventors: David R. Hall, 2185 S. Larsen Pkwy., Provo, UT (US) 84606; Scott Dahlgren, 2185 S. Larsen Pkwy., Provo, UT (US) 84606; Tyson J. Wilde, 2185 S. Larsen Pkwy., Provo, UT (US) 84606

( * ) Notice: Subject to any disclaimer, the term of this patent is extended or adjusted under 35 U.S.C. 154(b) by 78 days.

(21) Appl. No.: 11/555,334

(22) Filed: Nov. 1, 2006

(65) Prior Publication Data

US 2008/0099245 A1 May 1, 2008

(51) Int. Cl.
*E21B 10/36* (2006.01)

(52) U.S. Cl. ..... 175/414; 175/57; 175/405; 175/106

(58) Field of Classification Search ..... 175/57, 175/105, 106, 405, 414, 305
See application file for complete search history.

(56) References Cited

U.S. PATENT DOCUMENTS

| | | | |
|---|---|---|---|
| 616,118 | A | 12/1889 | Kunhe |
| 465,103 | A | 12/1891 | Wegner |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,387,733 | A | 8/1921 | Midget |
| 1,460,671 | A | 7/1923 | Hebsacker |
| 1,544,757 | A | 7/1925 | Hufford |
| 1,821,474 | A | 9/1931 | Mercer |
| 1,879,177 | A | 9/1932 | Gault |
| 2,054,255 | A | 9/1936 | Howard |
| 2,064,255 | A | 12/1936 | Garfield |
| 2,169,223 | A | 8/1939 | Christian |
| 2,218,130 | A | 10/1940 | Court |
| 2,320,136 | A | 5/1943 | Kammerer |
| 2,466,991 | A | 4/1949 | Kammerer |
| 2,540,464 | A | 2/1951 | Stokes |
| 2,544,036 | A | 3/1951 | Kammerer |
| 2,755,071 | A | 7/1956 | Kammerer |
| 2,776,819 | A | 1/1957 | Brown |
| 2,819,043 | A | 1/1958 | Henderson |
| 2,838,284 | A | 6/1958 | Austin |
| 2,894,722 | A | 7/1959 | Buttolph |
| 2,901,223 | A | 8/1959 | Scott |
| 2,963,102 | A | 12/1960 | Smith |
| 3,135,341 | A | 6/1964 | Ritter |
| 3,294,136 | A | 12/1966 | Buell |
| 3,301,339 | A | 1/1967 | Pennebaker |
| 3,379,264 | A | 4/1968 | Cox |
| 3,429,390 | A | 2/1969 | Bennett |

(Continued)

*Primary Examiner*—Jennifer H Gay
*Assistant Examiner*—Brad Harcourt
(74) *Attorney, Agent, or Firm*—Tyson J. Wide; Benjamin T. Miskin

(57) ABSTRACT

In one aspect of the invention, a downhole drill string component has a shaft being axially fixed at a first location to an inner surface of an opening in a tubular body. A mechanism is axially fixed to the inner surface of the opening at a second location and is in mechanical communication with the shaft. The mechanism is adapted to elastically change a length of the shaft and is in communication with a power source. When the mechanism is energized, the length is elastically changed.

17 Claims, 13 Drawing Sheets

U.S. PATENT DOCUMENTS 3,493,165 A 2/1970 Schonfield
3,583,504 A 6/1971 Aalund
3,764,493 A 10/1973 Rosar
3,807,512 A * 4/1974 Pogonowski et al. ..... 175/106
3,821,993 A 7/1974 Kniff
3,955,635 A 5/1976 Skidmore
3,960,223 A 6/1976 Kleine
4,081,042 A 3/1978 Johnson
4,096,917 A 6/1978 Harris
4,106,577 A 8/1978 Summer
4,176,723 A 12/1979 Arceneaux
4,253,533 A 3/1981 Baker
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,640,374 A 2/1987 Dennis
4,852,672 A 8/1989 Behrens
4,889,017 A 12/1989 Fuller
4,962,822 A 10/1990 Pascale
4,981,184 A 1/1991 Knowlton
5,009,273 A 4/1991 Grabinski
5,027,914 A 7/1991 Wilson
5,038,873 A 8/1991 Jurgens
5,119,892 A 6/1992 Clegg
5,141,063 A 8/1992 Quesenbury
5,186,268 A 2/1993 Clegg
5,222,566 A 6/1993 Taylor
5,255,749 A 10/1993 Bumpurs
5,265,682 A 11/1993 Russell
5,361,859 A 11/1994 Tibbitts
5,410,303 A 4/1995 Comeau
5,417,292 A 5/1995 Polakoff
5,423,389 A 6/1995 Warren
5,507,357 A 4/1996 Hult
5,560,440 A 10/1996 Tibbitts
5,568,838 A 10/1996 Struthers
5,655,614 A 8/1997 Azar
5,678,644 A 10/1997 Fielder
5,732,784 A 3/1998 Nelson
5,794,728 A 8/1998 Palmberg
5,896,938 A 4/1999 Moeny
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott
5,992,547 A 11/1999 Caraway
5,992,548 A 11/1999 Silva
6,021,859 A 2/2000 Tibbitts
6,039,131 A 3/2000 Beaton
6,131,675 A 10/2000 Anderson
6,150,822 A 11/2000 Hong
6,186,251 B1 2/2001 Butcher
6,202,761 B1 3/2001 Forney
6,213,226 B1 4/2001 Eppink
6,223,824 B1 5/2001 Moyes
6,269,893 B1 8/2001 Beaton
6,292,069 B1 10/2001 Lamine
6,340,064 B2 1/2002 Fielder
6,364,034 B1 4/2002 Schoeffler
6,394,200 B1 5/2002 Watson
6,439,326 B1 8/2002 Huang et al.
6,474,425 B1 11/2002 Truax
6,484,825 B2 11/2002 Watson
6,510,906 B1 1/2003 Richert
6,513,606 B1 2/2003 Krueger
6,533,050 B2 3/2003 Molloy
6,594,881 B2 7/2003 Tibbitts
6,601,454 B1 8/2003 Botnan
6,622,803 B2 9/2003 Harvey
6,668,949 B1 12/2003 Rives
6,729,420 B2 5/2004 Mensa-Wilmot
6,732,817 B2 5/2004 Dewey
6,822,579 B2 11/2004 Goswani
6,877,569 B2 * 4/2005 Koskimaki ..... 173/1
9,629,076 4/2005 Fanuel
6,953,096 B2 10/2005 Glenhill
2003/0213621 A1 11/2003 Britten
2004/0238221 A1 12/2004 Runia
2004/0256155 A1 12/2004 Kriesels
2008/0017419 A1 * 1/2008 Cooley et al. ..... 175/286

* cited by examiner

CAM ASSEMBLY IN A DOWNHOLE COMPONENT

BACKGROUND OF THE INVENTION

The current invention relates to the field of downhole drilling, including horizontal drilling, oil and gas drilling, geothermal drilling, dry hot rock drilling, mining, and exploratory drilling. In downhole drilling applications, several different methods and bits for impacting or drilling into rock formations have typically been used. Among these methods are rotary or shear drill bits, percussion bits, and roller cone bits. There are also drill bits which use both shearing and percussive forces for drilling. Some inventions of the prior art also have methods for centering a drill bit or for reducing bit whirl while drilling.

U.S Pub. No. 2002/0166700 by Gillis et al., which is herein incorporated by reference for all that it contains, discloses an apparatus for introducing a consistent series of small and localized rotary impacts to a PDC bit during drilling to improve PDC drill bit performance. Rotary impact supplements the nominal torque supplied by the rotary drive thereby avoiding lockup and potentially damaging energy storage in the drill string following windup, should the bit slow or hang up when drilling in difficult formations. The apparatus comprises a rotary hammer which is rotated about a bit shaft's anvil, preferably by a drilling fluid driven turbine. As the hammer rotates, potential energy is built up. When the hammer and anvil connect, the energy is released into the bit shaft and thus into the bit, increases its instantaneous torque and allows it to more effectively cut through difficult formations.

U.S. Pat. No. 6,948,560 by Marsh, which is herein incorporated by reference for all that it contains, discloses a jar for use in a downhole toolstring comprising: a hollow housing; a jar mandrel; a latch sub; one or more latch keys; a cam surface; a chamber; a compression spring; and an adjuster.

U.S. Pat. No. 6,877,569 by Koskimaki, which is herein incorporated by reference for all that it contains, discloses a method for controlling the operating cycle of an impact device, and an impact device. Percussion piston position is measured using a sensor from which the measurement data is transmitted to a control unit of the impact device, which in turn controls an electrically driven control valve.

U.S. Pat. No. 6,745,836 by Taylor, which is herein incorporated by reference for all that it contains, discloses a self-contained radial drive unit that is driven by a linear input, which can be supplied from various source. As linear motion is applied to the input of the tool, drive pins on a drive shaft follow a helical path, converting the linear motion into radial motion at the attached mandrel end.

BRIEF SUMMARY OF THE INVENTION

A downhole drill string component has a shaft being axially fixed at a first location to an inner surface of an opening in a tubular body. A cam assembly is axially fixed to the inner surface of the opening at a second location and is in mechanical communication with the shaft. The cam assembly is adapted to elastically change a length of the shaft and is in communication with a power source, wherein, when the cam assembly is energized, the length is elastically changed.

The downhole component may comprise sensors. The downhole component may be selected from the group consisting of drill pipes, production pipes, heavyweight pipes, reamers, bottomhole assembly components, jars, swivels, drill bits, and subs. The downhole component may comprise a thrust bearing. The thrust bearing may comprise a finish surface with a hardness greater than 63 HRc.

The first and second locations may be at least 1 foot apart. The first and second locations may be proximate opposite ends of the shaft.

The mechanism may comprise a surface with a hardness greater than 58 HRc. The surface may comprise a material selected from the group consisting of chromium, tungsten, tantalum, niobium, titanium, molybdenum, carbide, cubic boron nitride, TiN, AlNi, AlTiNi, TiAlN, CrN/CrC/(Mo, W)S2, TiN/TiCN, AlTiN/MoS2, TiAlN, ZrN, whisker reinforced ceramics, natural diamond, synthetic diamond, polycrystalline diamond, vapor deposited diamond, layered diamond, infiltrated diamond, thermally stable diamond, diamond impregnated carbide, diamond impregnated matrix, silicon bonded diamond, cobalt bonded diamond, polished diamond, and combinations thereof The mechanism may comprise a cam. The cam may comprise teeth that are stepped, jagged, smooth, unequal, asymmetrical, parabolic, or combinations thereof The mechanism may comprise a piezoelectric material, a magnetostrictive material, solenoid, pump, valve, gear, pulley, or combinations thereof The mechanism may comprise a polished finish.

The shaft may extend into an opening of an adjacent second downhole drill string component. The shaft may be a stabilizing jack element extending beyond a face of the component, wherein the component is a drill bit.

A method for changing a length of at least a portion of a downhole component comprises the steps of providing a shaft axially fixed at a first location within an opening of the component; providing a linear actuator for elastically changing the length of the at least portion of the component, the linear actuator being axially fixed at a second location within the opening; providing a power source in communication with the linear actuator; and elastically changing the length by powering the linear actuator. The length is elastically changed by 0.001 to 0.01 inches.

DETAILED DESCRIPTION OF THE INVENTION AND THE PREFERRED EMBODIMENT

Figure 1:
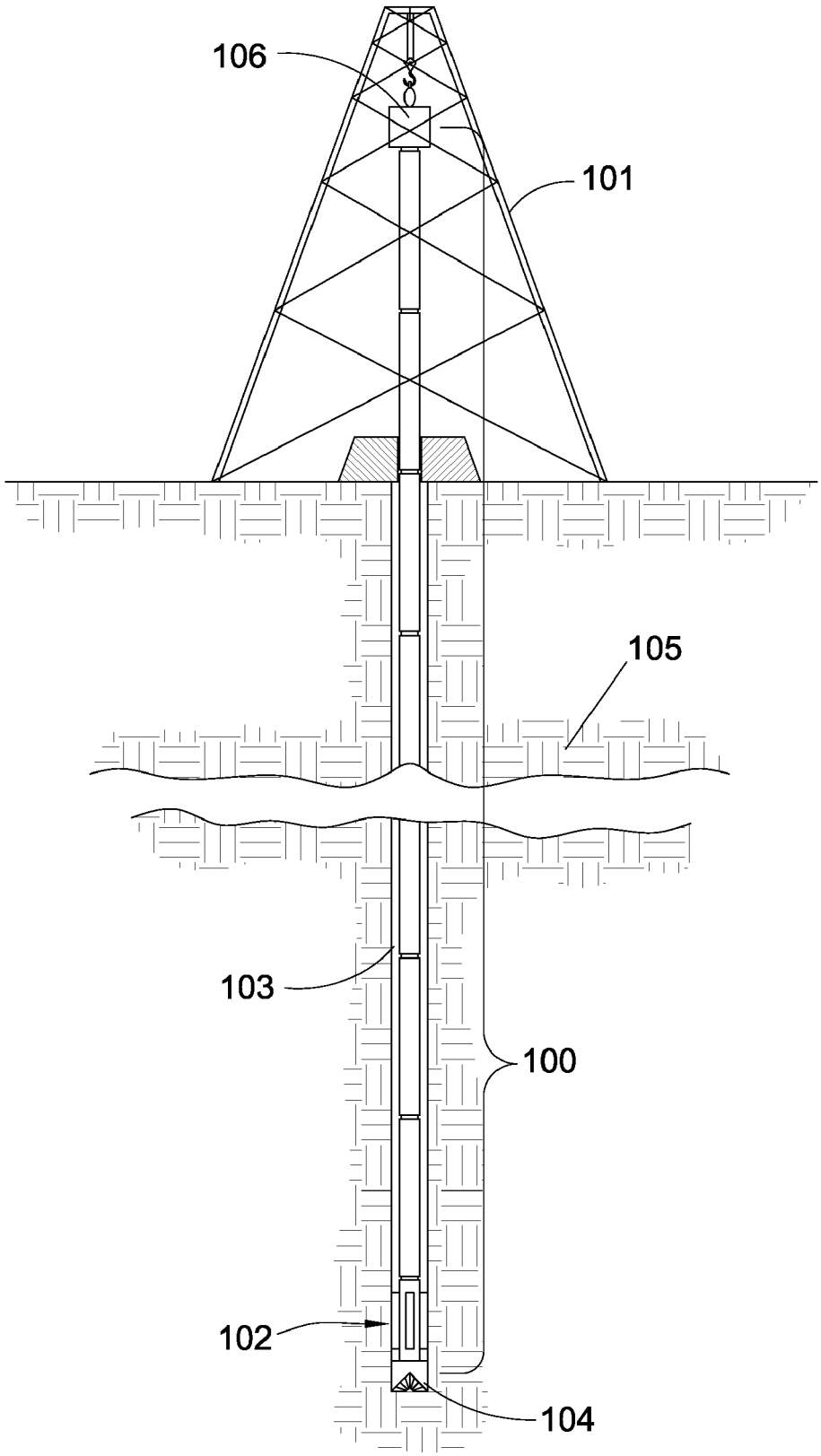
FIG. 1 is a cross-sectional diagram of an embodiment of a drill string suspended in a bore hole.

FIG. 1 is an embodiment of a drill string 100 suspended by a derrick 101. A bottom-hole assembly 102 is located at the bottom of a bore hole 103 and comprises a drill bit 104. As the drill bit 104 rotates downhole the drill string 100 advances farther into the earth. The drill string may penetrate soft or hard formations 105. The bottom-hole assembly 102 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 102.

Figure 2:
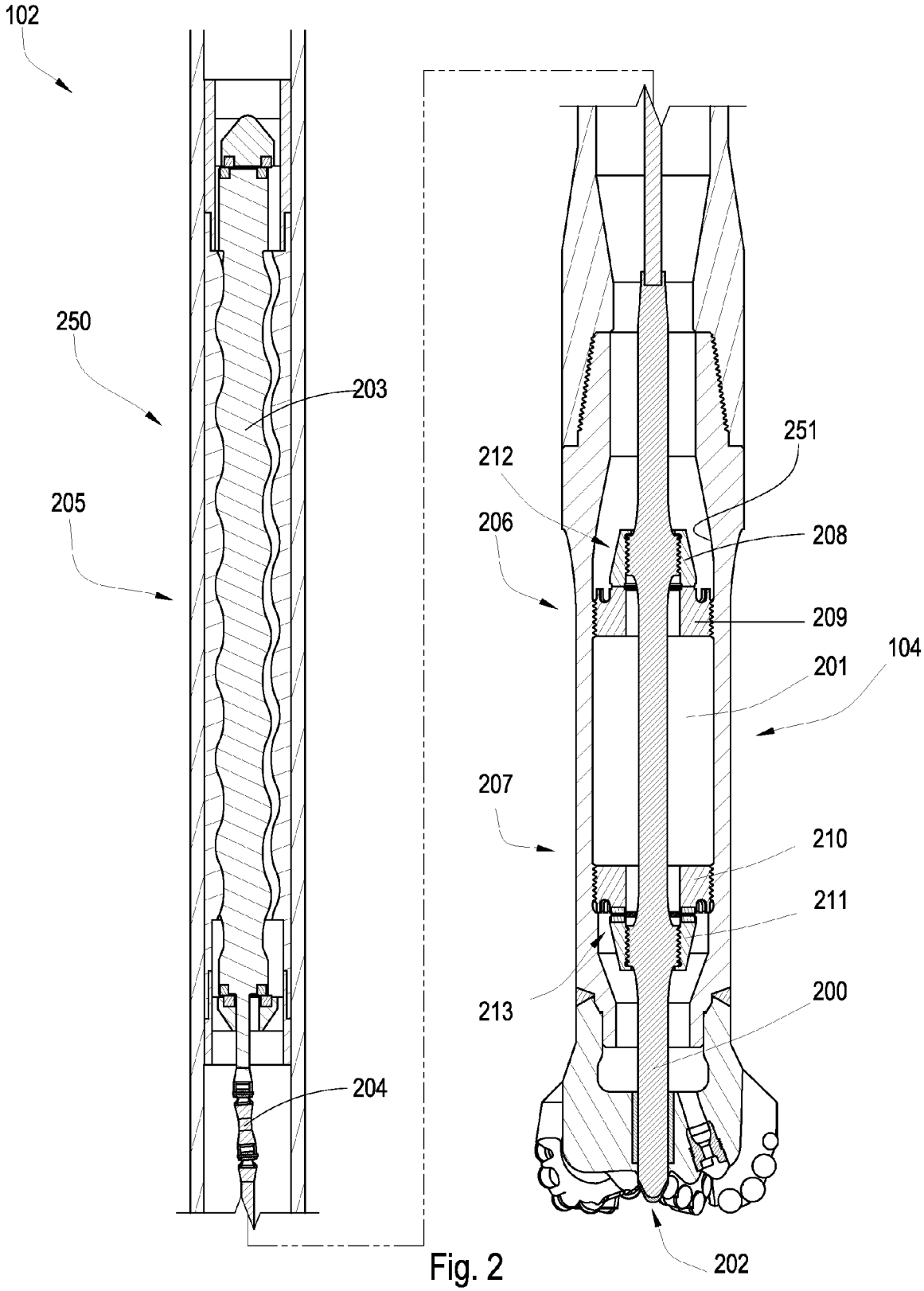
FIG. 2 is a cross-sectional diagram of an embodiment of a bottom hole drill string assembly.

In the embodiment of FIG. 2, the bottom-hole assembly 102 comprises a drill string component 205, such as a drill collar, and a shear drill bit 104. The bottom-hole assembly 102 comprises a jack element 200 disposed within the bore 201 of the drill bit 104 and extending from a face 202 of the drill bit 104 up into the bore 201 of the drill string component. The jack element 200 is in communication with a motor 250, which may be a positive displacement motor. Fluid passing through the motor 250 causes its rotor 203 to nutate. The jack element 200 may be connected to the rotor 203 by a joint 204 such as a u-joint, which would allow the rotor 203 to nutate while the jack element 200 remains centered with respect to the central axis of the drill string component 205. The rotor 203 may counter-rotate with the rotation of the drill string 100 such that the jack element 200 remains substantially rotationally stationary with respect to the formation, which may result in reducing bit whirl. The jack element 200 is axially fixed to the drill bit 104 at first and second locations 206, 207, wherein the first location 206 is closer to the motor 250 and the second location 207 is closer to the face 202.

A thrust bearing assembly 212 is positioned at the first location 206 and disposed around the jack element 200, wherein a first bearing 208 is attached to the jack element 200 and a second bearing 209 is attached to the wall 251 of the bore 201. The first bearing 208 is positioned closer to the rotor 203 while the second bearing 209 is positioned closer to the face 202 of the drill bit 104. A cam assembly 213 is positioned at the second location 207 and disposed around the jack element 200, wherein the cam assembly comprises a first cam 210 positioned closer to the motor 250 and is attached to the wall 251 of the bore 201, and a second cam 211 positioned closer to the face 202 and is attached to the jack element 200. The first cam 210 and the second bearing 209 are rotationally and axially fixed to the wall, while the second cam 211 and the first bearing 208 are not axially fixed to the wall and are allowed to rotate with the jack element 200.

Figure 3:
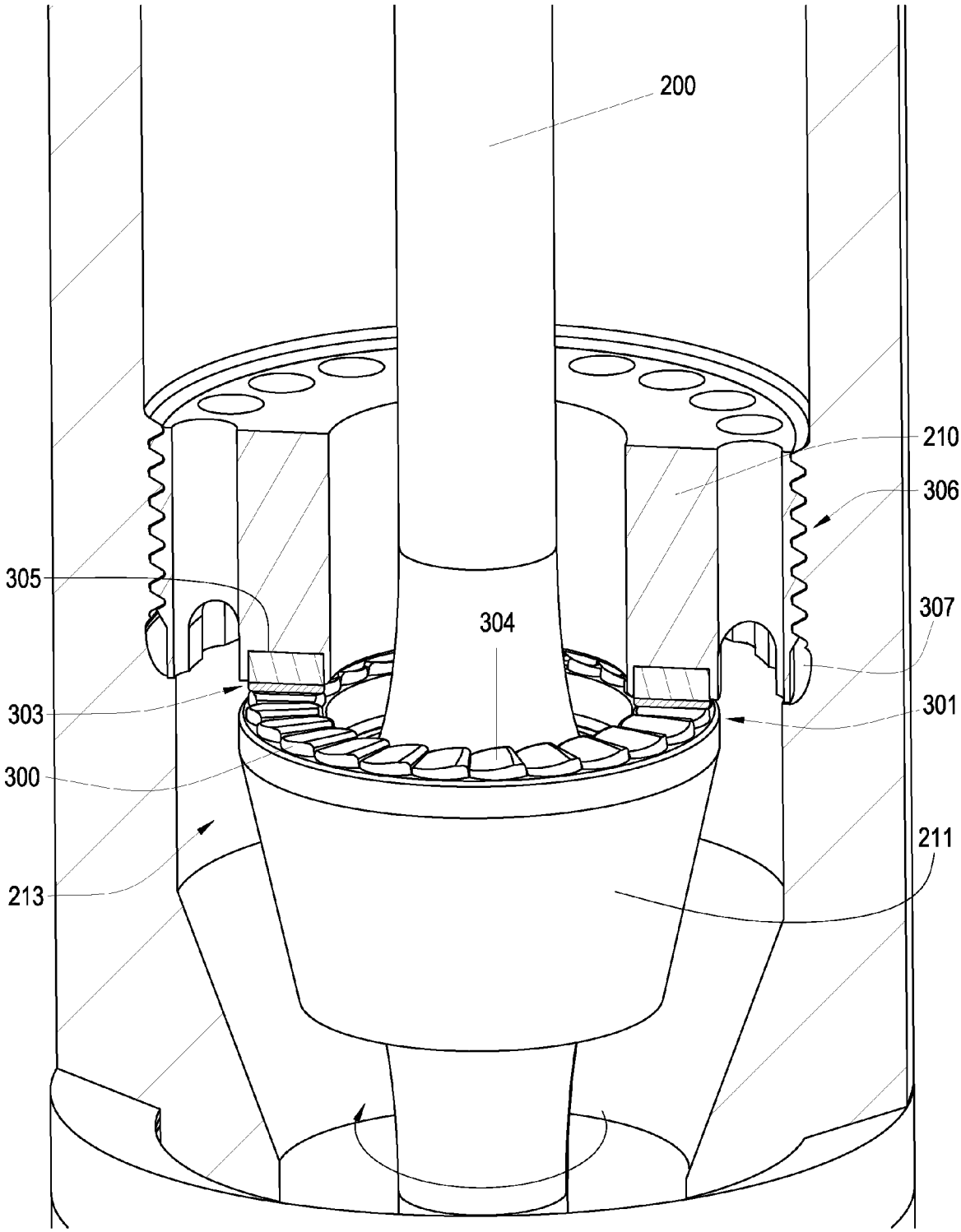
FIG. 3 is a sectional diagram of an embodiment of a cam assembly.

Referring now to FIG. 3, the cam assembly 213 may comprise a plurality of inserts 300. Inserts 300 are disposed within an upper face 301 of the cam 211 attached to a jack element 200, and inserts 300 are also disposed within a lower face 303 of the cam 210 attached to the wall of the bore 201. An exposed surface 304 of each insert 300 is positioned at an angle with the face within which they are disposed, resulting in a tooth-like array. The angle at which the inserts 300 are positioned may be varied according to the amount of stretching desired. The inserts 300 may be press fit or brazed into recesses 305 in the face of the cam at an angle or the surfaces 304 of the inserts 300 could be machined at an angle such that the inserts 300 may be press fit or brazed into recesses 305 perpendicular to the face of the cam. The inserts 300 may be spaced as little as 0.01 inches apart to protect as much of the face of the cam as possible. The inserts 300 in each individual cam 210, 211 in the cam assembly may be inserted at different angles to create different angles of contact between the inserts 300 when the cams are engaged. The first cam 210 comprises a plurality of openings wherein drilling fluid is allowed to pass through while the cam assembly is engaged. The cams may also be threadedly connected to the jack element 200 or wall of the bore 201.

Threaded portions 306 of the wall of the bore 201 or jack element 200 may comprise a stress relief groove 307. The rotating cam assembly may cause compression in the threaded portions of the cam or thrust bearing assemblies and a stress relief groove may improve the life of the threaded portions. In other embodiments, the cam and thrust assemblies are held in place with welds, bolts, keys, compression fits, adhesives or combinations thereof.

Figure 4:
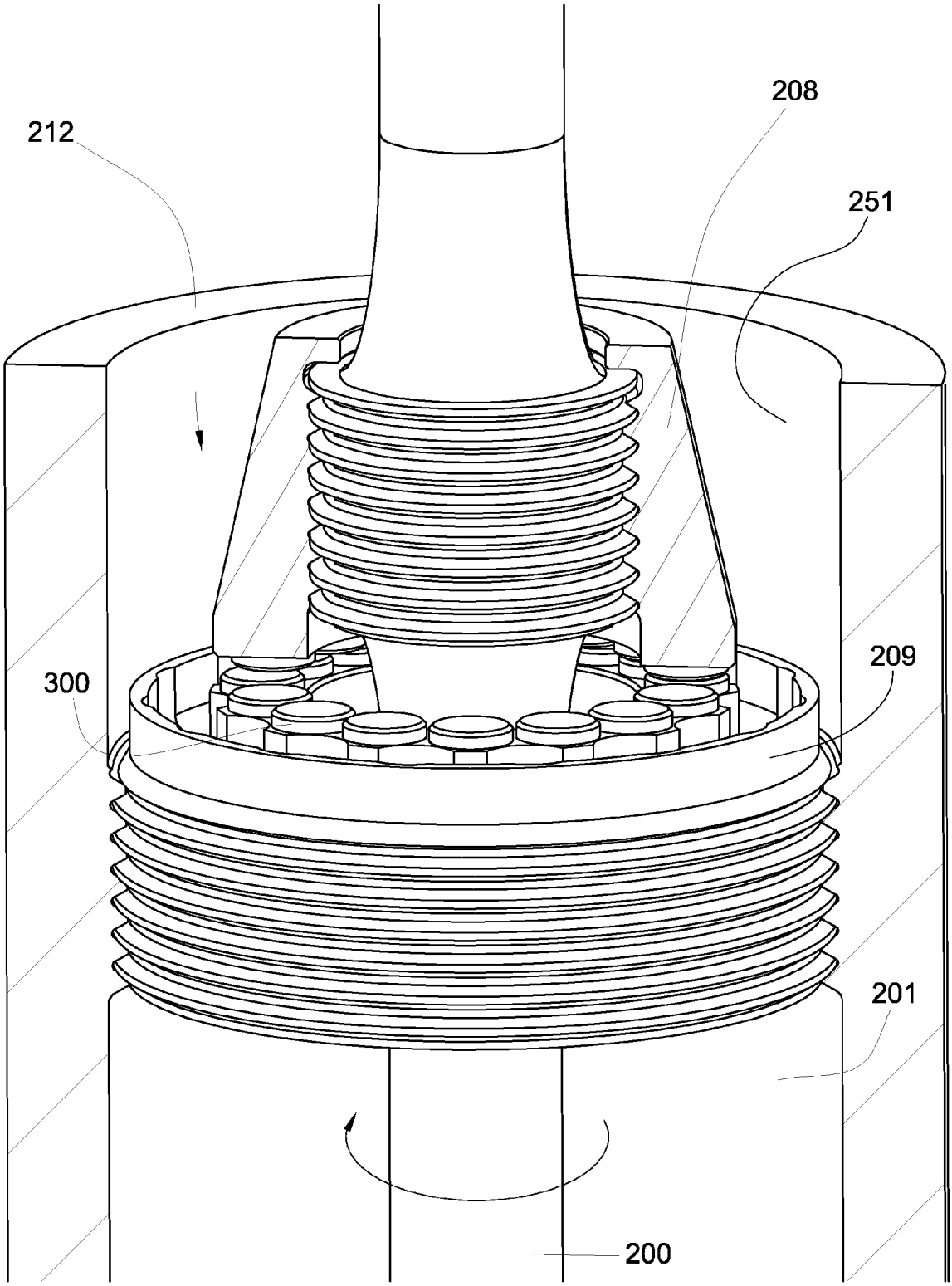
FIG. 4 is a sectional diagram of an embodiment of a thrust bearing assembly.

Referring to FIG. 4, the thrust bearing assembly 212 may also be threadedly connected to the jack element 200 or wall 251 of the bore 201. The bearings may comprise inserts 300. The inserts 300 are disposed within the first and second bearings 208, 209 and are positioned to create a flat, smooth surface such that as the jack element 200 rotates, the first bearing 208 is able to rotate smoothly while in contact with the second bearing 209. The purpose of the thrust bearings is to allow the jack element 200 to rotate while holding a portion of the jack element 200 axially in the same position. In order to reduce friction and wear on the bearings, the bearings may comprise a finish surface with a hardness greater than 63 HRc.

Figure 5A:
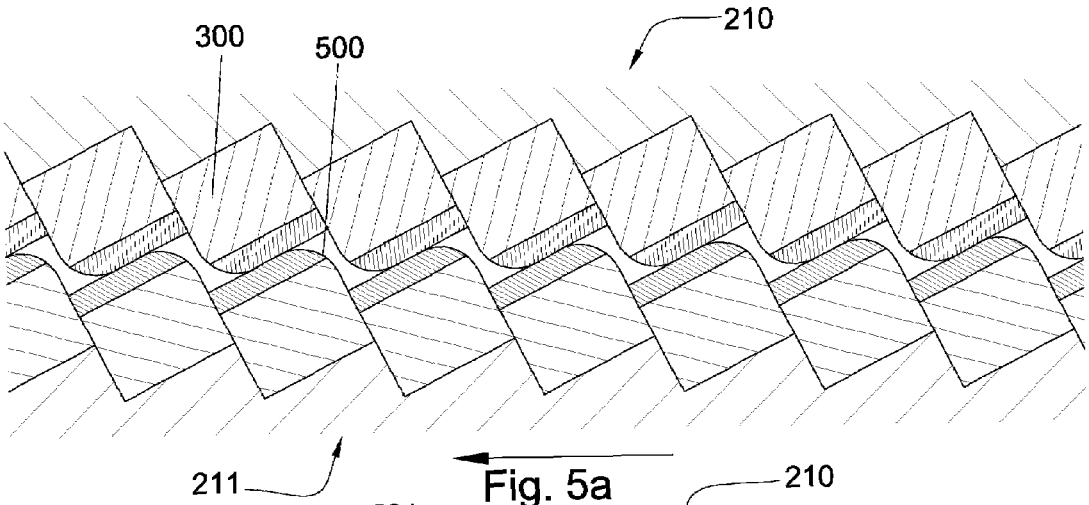
FIG. 5*a* is a cross-sectional diagram of another embodiment of a cam assembly.
Figure 5B:
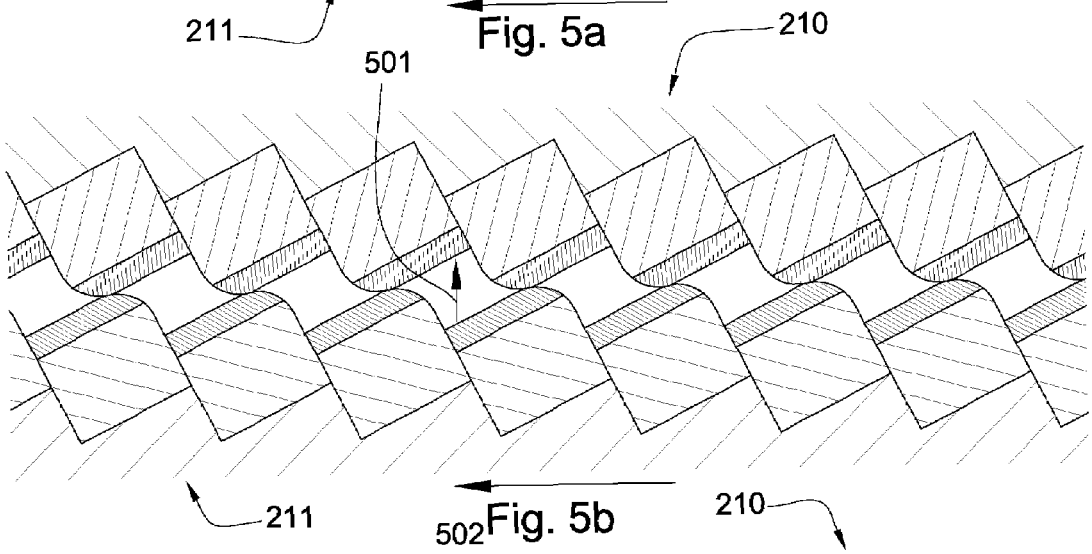
FIG. 5*b* is a cross-sectional diagram of another embodiment of a cam assembly.
Figure 5C:
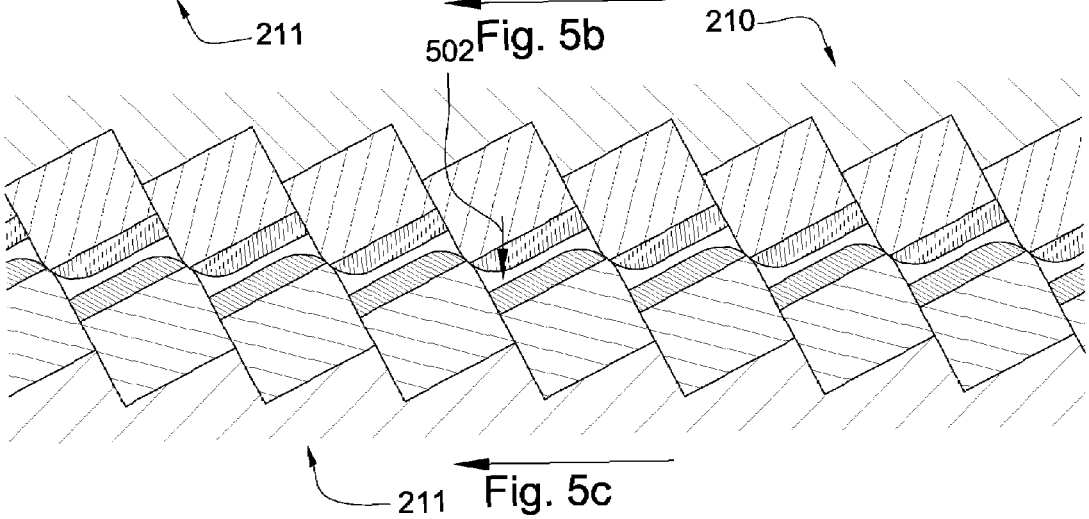
FIG. 5*c* is a cross-sectional diagram of another embodiment of a cam assembly.

The inserts 300 may also comprise rounded or chamfered edges 500, as in the embodiment of FIG. 5*a*. The rounded edges 500 may reduce point forces at the point of contact or lessen the impact against the surfaces 304 of the inserts 300. By lessening the impact against the surfaces, the inserts may last longer and lengthen the life of the cam. Because the first cam 210 is axially fixed to the wall of the bore 201 and the second cam 211 is not (See FIG. 2), as the second cam rotates with the jack element 200, the tooth design causes the second cam 211 to push away from the first cam 210, as indicated by the upward arrow 501 (See No. 501 of FIG. 5*b*), stretching the portion of the jack element 200 between the thrust bearing assembly and the cam assembly thereby increasing the length of the jack element 200. As the second cam 211 continues to rotate it returns to its original axial position as indicated by the downward arrow (See No. 502 of FIG. 5*c*), releasing the tension in the shaft 302. The continuous stretching and releasing of the jack element 200 creates a vibrating effect which may aid the jack element 200 in compressively failing the formation The length of the jack element 200 may be elastically changed by 0.001 to 250 inches, preferably between 0.015 to 050 inches.

Figure 6:
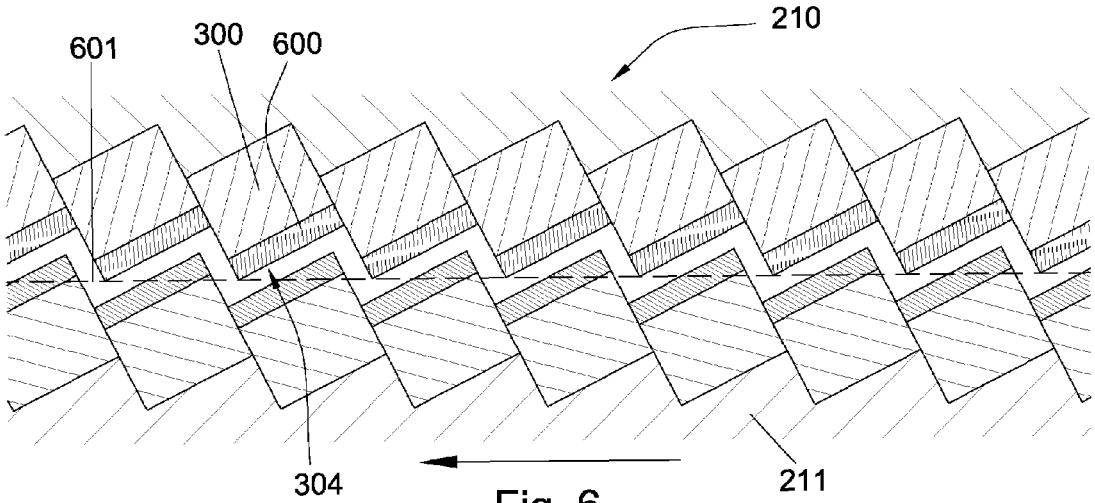
FIG. 6 is a cross-sectional diagram of another embodiment of a cam assembly.

Referring to FIG. 6, because the faces of the cams are subject to high amounts of friction and impact forces, the inserts 300 may comprise a surface 304 made from a wear-resistant material 600 with a hardness greater than 63 HRc. The material 600 may be selected from the group consisting of chromium, tungsten, tantalum, niobium, titanium, molybdenum, carbide, cubic boron nitride, TiN, AlNi, AlTiNi, TiAlN, CrN/CrC/(Mo, W)S2, TiN/TiCN, AlTiN/MoS2, TiAlN, ZrN, whisker reinforced ceramics, natural diamond, synthetic diamond, polycrystalline diamond, vapor deposited diamond, layered diamond, infiltrated diamond, thermally stable diamond, diamond impregnated carbide, diamond impregnated matrix, silicon bonded diamond, cobalt bonded diamond, polished diamond, and combinations thereof.

Initially, the inserts 300 may be cylindrical. If both cams 210, 211 in the cam assembly comprise cylindrical inserts, the inserts of the cams may contact at a point because of the geometries of the inserts. This point contact may bear all of the force from another insert. This may result in too high unsupported loads which may cause chipping of the wear-resistant material 600 as an insert transitions from one insert to another insert as the cam assembly rotates. By truncating the cylindrical inserts on two opposite sides, the inserts of the cams may contact along a line, thereby distributing the high loads and reducing the amount of wear experienced on the insert. This is believed to reduce the chance of chipping the material 600 on the inserts 300.

The cam assembly may also be designed such that as the jack element 200 rotates, the inserts of the cam 211 attached to the jack element 200 don't impact immediately against the inserts of the other cam 210 as the rotating cam 211 returns to its original position. The path of the lowest point of travel for the rotating cam is indicated by the dashed line 601. This may be accomplished by spacing the cams apart at a predetermined distance.

Figure 7:
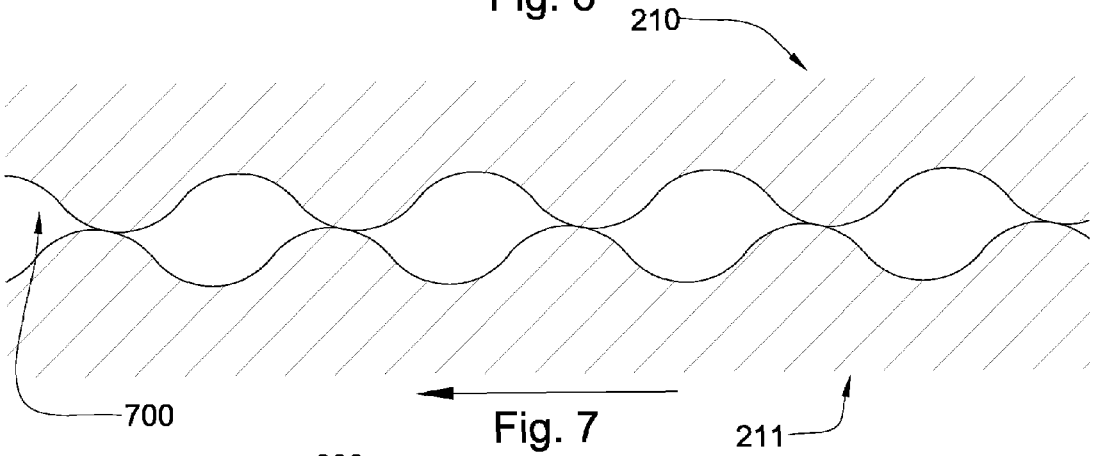
FIG. 7 is a cross-sectional diagram of another embodiment of a cam assembly.
Figure 8:
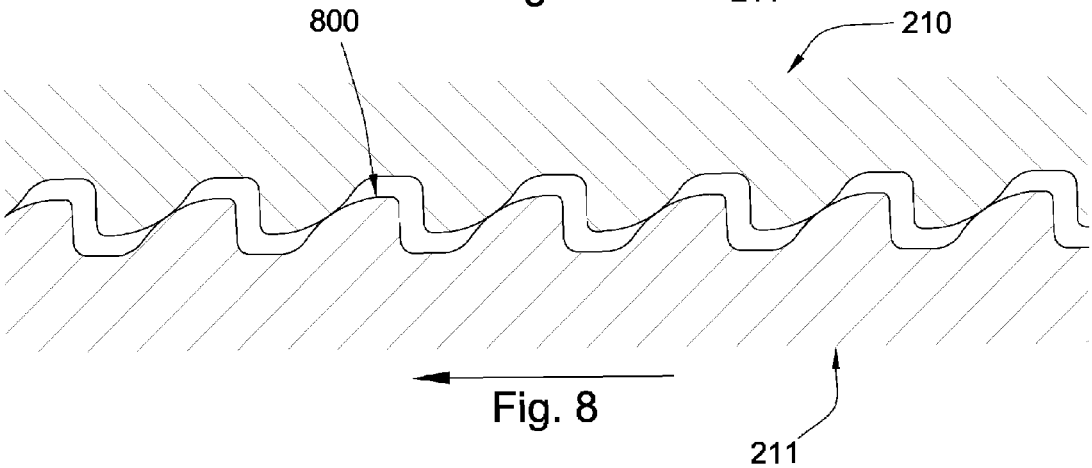
FIG. 8 is a cross-sectional diagram of another embodiment of a cam assembly.

The cam may also comprise a face with a different geometry, wherein the different geometry is formed by inserts 300 or by the face of the cam itself The face may comprise a sinusoidal geometry 700, as in the embodiment of FIG. 7. The sinusoidal geometry 700 may be used to generate a symmetrical oscillatory pattern while stretching the jack element 200 or downhole component. The teeth of the face may comprise a convex geometry 800, such as in the embodiment of FIG. 8, or any geometry.

Figure 9:
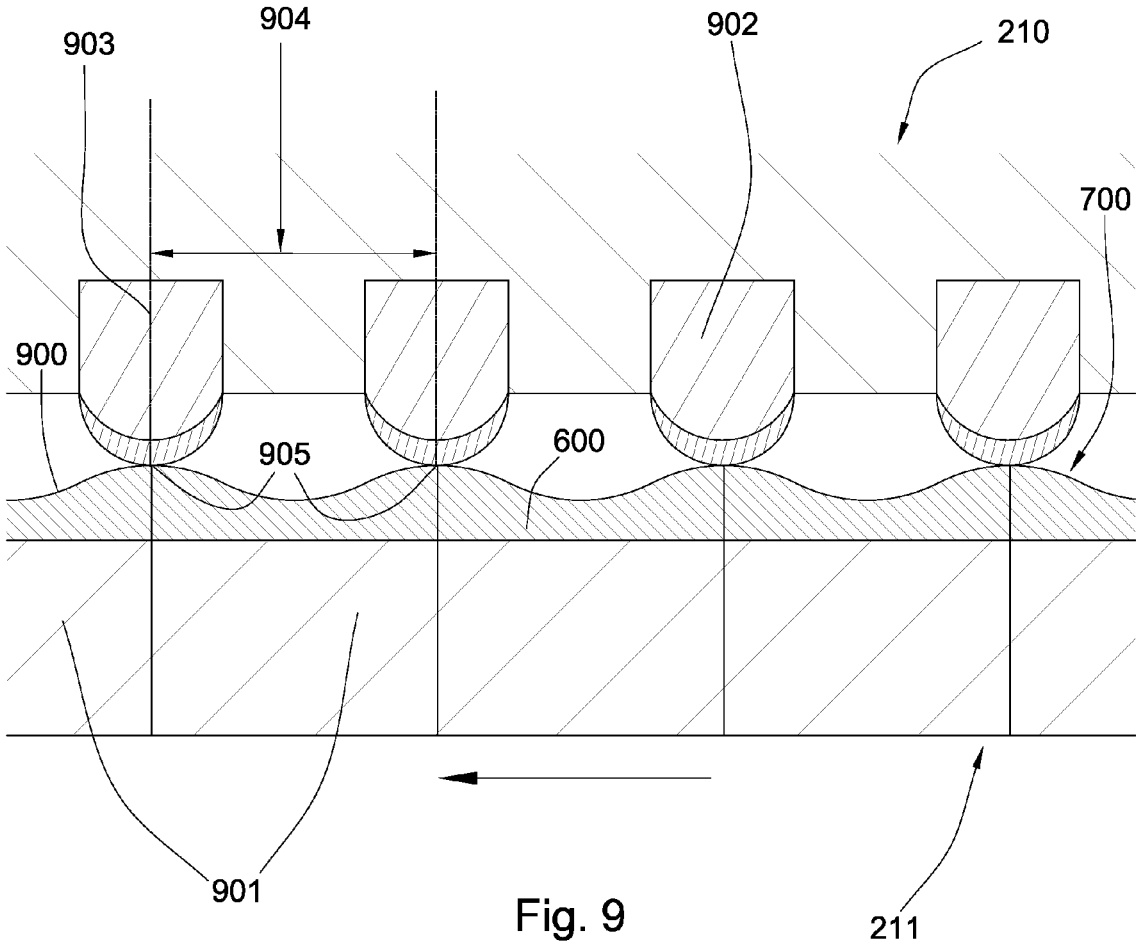
FIG. 9 is a cross-sectional diagram of another embodiment of a cam assembly.

Referring now to FIG. 9, an alternate embodiment of the cam assembly may comprise a first cam 210 which comprises a plurality of inserts 901 positioned flush with each other, wherein the inserts 901 make a face 900 with a sinusoidal geometry 700. The sinusoidal geometry may be created in the wear-resistant material 600 with an electric discharge machine. The inserts of the first cam 210 may be pre-flatted to accommodate a tight fit between the inserts and provide a continuous sinusoidal surface. The cam assembly may also comprise a second cam 211 which comprises a plurality of inserts 902 whose centers 903 are spaced at a certain distance 904 apart such that the distance 904 is equal to the distance between two peaks 905 of the sinusoidal geometry of the first cam 210. As the second cam 211 rotates, the second cam 211 pushes away from the first cam 210. The inserts of the second cam 211 may comprise a domed geometry, a rounded geometry or a conical geometry. Although these geometries allow the inserts to contact at a point, the inserts of the second cam are designed to buttress the high loads generated since the point contact occurs proximate the apex of the inserts.

Figure 10:
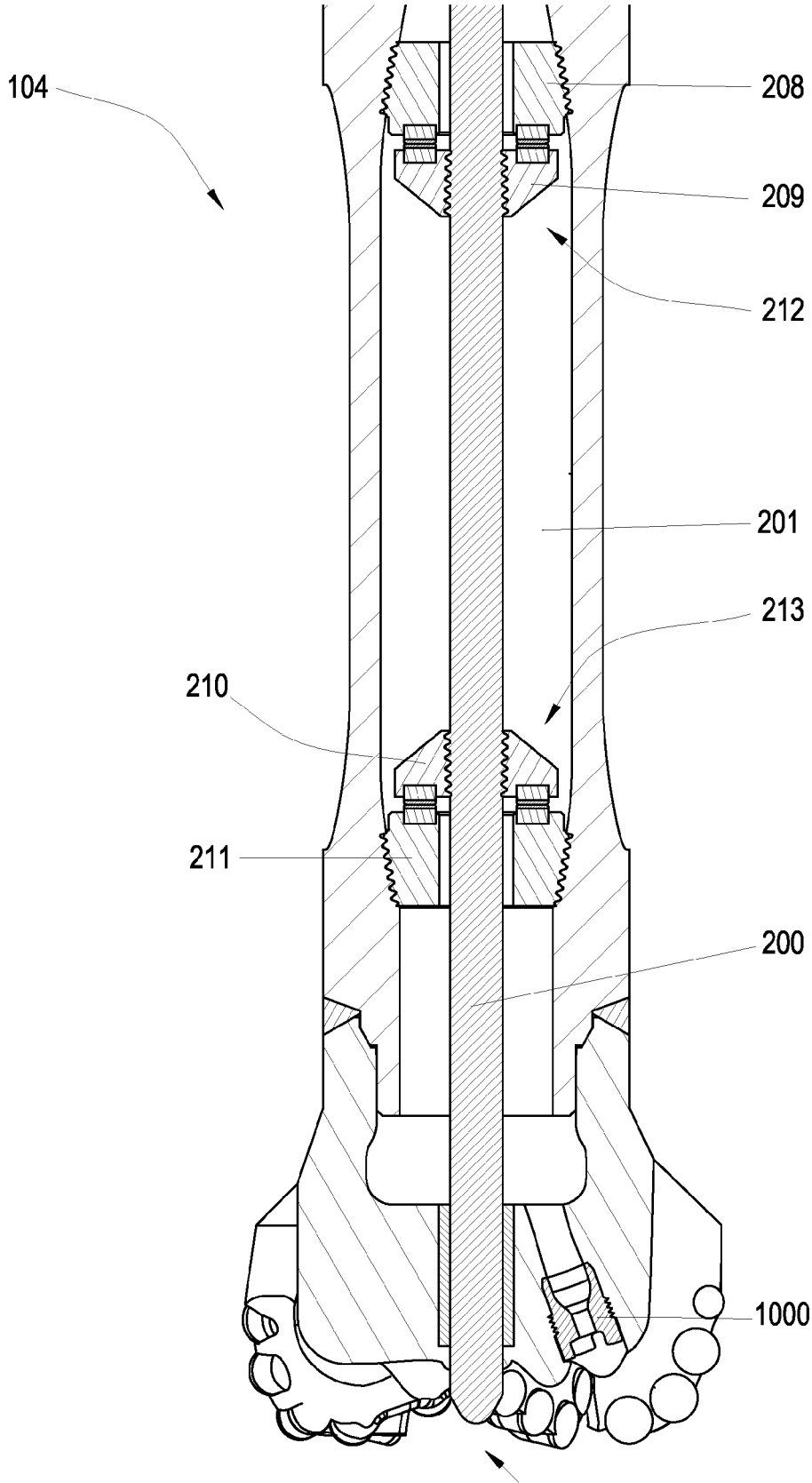
FIG. 10 is a cross-sectional diagram of an embodiment of a drill bit.

Referring now to the embodiment of FIG. 10, the present invention may be used to vibrate the drill bit 104. A jack element 200 may extend from the face 202 of the drill bit 104 and may be disposed within the bore 201 of the drill bit 104. The jack element 200 may also extend into the bore 201 of an adjacent drill string component where it may be in communication with a motor. The cam and thrust bearing assemblies 213, 212 may be disposed within the drill bit 104. The drill bit 104 may comprise cam/thrust bearing assemblies 213, 212 in positions such that the jack element 200 is compressed and a portion of the drill bit 104 is stretched. To accomplish this effect, the first bearing 208 is attached to the wall of the bore 201 and the second bearing 209 is attached to the jack element 200, while the first cam 210 is attached to the jack element 200 and the second cam 211 is attached to the wall of the bore 201. As the first cam 210 rotates, a portion of the drill bit 104 in between the first and second locations 206, 207 is stretched and released. The compressing of the jack element 200 and the stretching of the drill bit 104 may have the multiple effects of vibrating both the jack element 200 and the drill bit 104, which may aid the drilling process.

The drill bit 104 may also comprise nozzles 1000 where jets of fluid may be emitted from the face 202 of the drill bit 104 into the formation. The vibration caused by the stretching and releasing of the drill bit 104 in addition to the jets of fluid may help keep the face of the drill bit 104 free of particles from the formation, making the drilling more efficient.

In some embodiments of the present invention, the thrust bearing may be replaced with another cam assembly. Each cam assembly may be adapted to stretch the jack element or the drill string component 0.015 inches, which would result in an overall length change of 0.030 inches. Several cam assemblies may be used to affect the overall change. Since the cams are subjected to high amounts of wear, several cams may help distribute the loads over a greater area allowing for the same overall length change while reduces wear on the cams.

In some embodiments, smart materials, such as piezoelectric or magnetostrictive materials, may be used to affect the stretch. Power required to operate the smart materials may be supplied by a downhole generator. A motor or turbine placed downhole may be adapted with magnets and coil windings such that as motor or turbine spins electrical power may be generated. The stretching may also be caused by solenoids, pumps, valves, gears, or pulleys. A portion of the stretching mechanism may be protected from drilling fluid by a casing within the bore of the drill string component.

Figure 11:
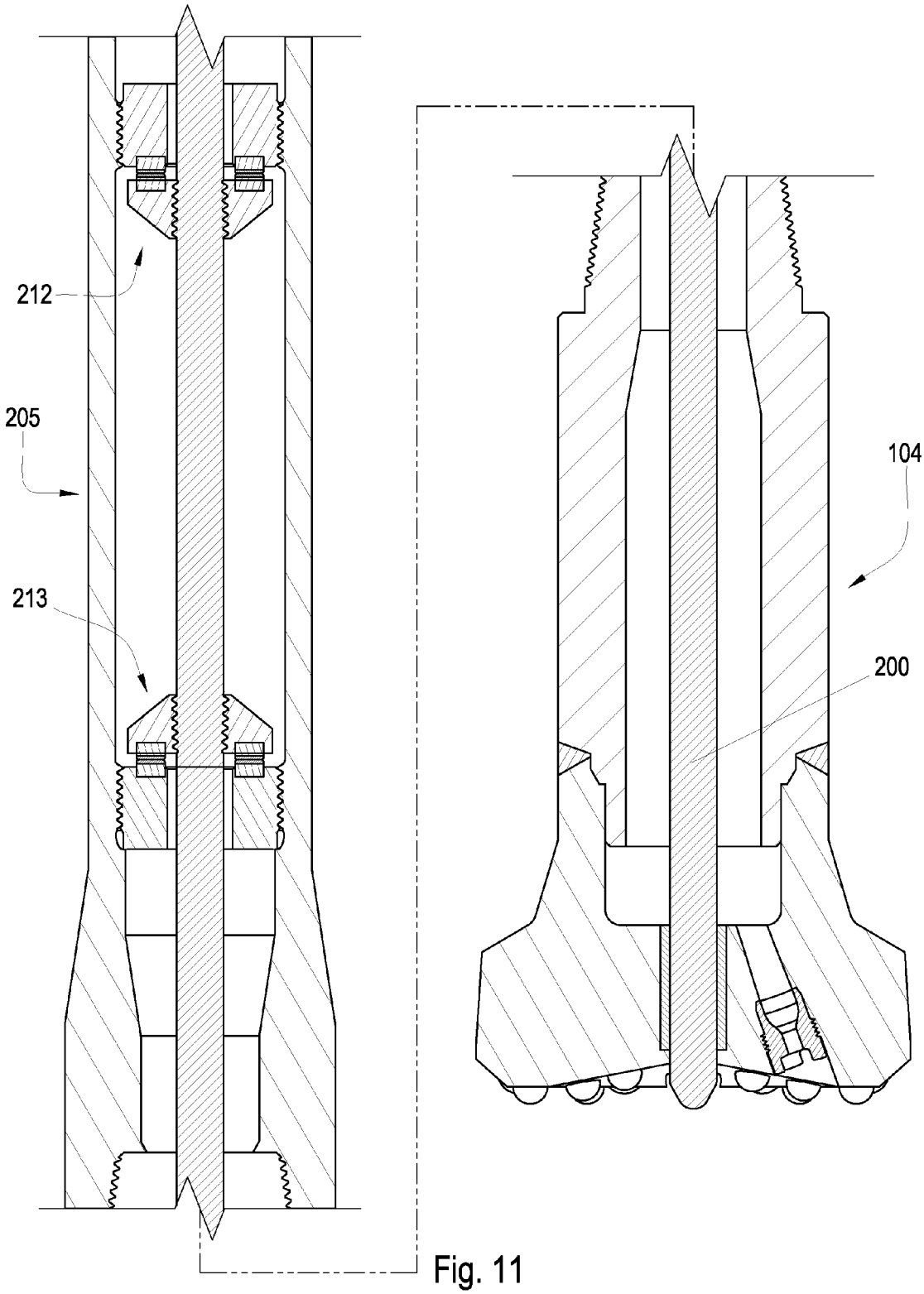
FIG. 11 is a cross-sectional diagram of another embodiment of a bottomhole drill string assembly.

The cam/thrust bearing assemblies 213, 212 may be disposed within a downhole component 205 proximate the drill bit 104. In the embodiment of FIG. 11, the component is a drill collar proximate a percussion bit. The component may also be selected from the group consisting of drill pipes, production pipes, heavyweight pipes, reamers, bottomhole assembly components, jars, swivels, drill bits, and subs. The configuration of the cam/thrust bearing assemblies 213, 212 is similar to that in FIG. 10 in that a portion of the drill pipe 205 is stretched and the jack element 200 is compressed.

Figure 12:
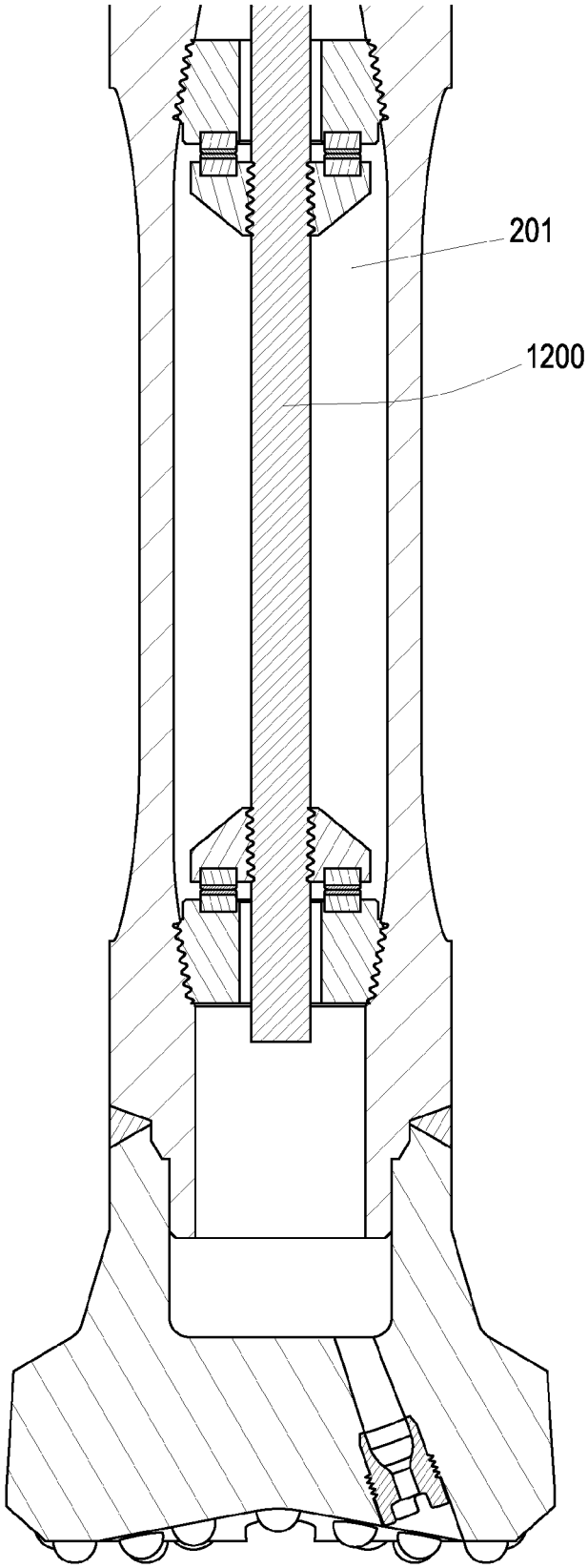
FIG. 12 is a cross-sectional diagram of another embodiment of a drill bit.

Referring now to FIG. 12, a shaft 1200 extends into the bore 201 of the drill bit 104 from the bore 201 of a component proximate the drill bit 104, the shaft 1200 being in communication with a motor. The vibration in the drill bit 104 caused by the present invention in accordance with the rotation of the drill bit 104 may be sufficient to bore through soft or hard formations. It may be particularly useful for using percussive drill bits in a fluid environment where drilling fluid passes through the bore 201 of the drill string.

Figure 13:
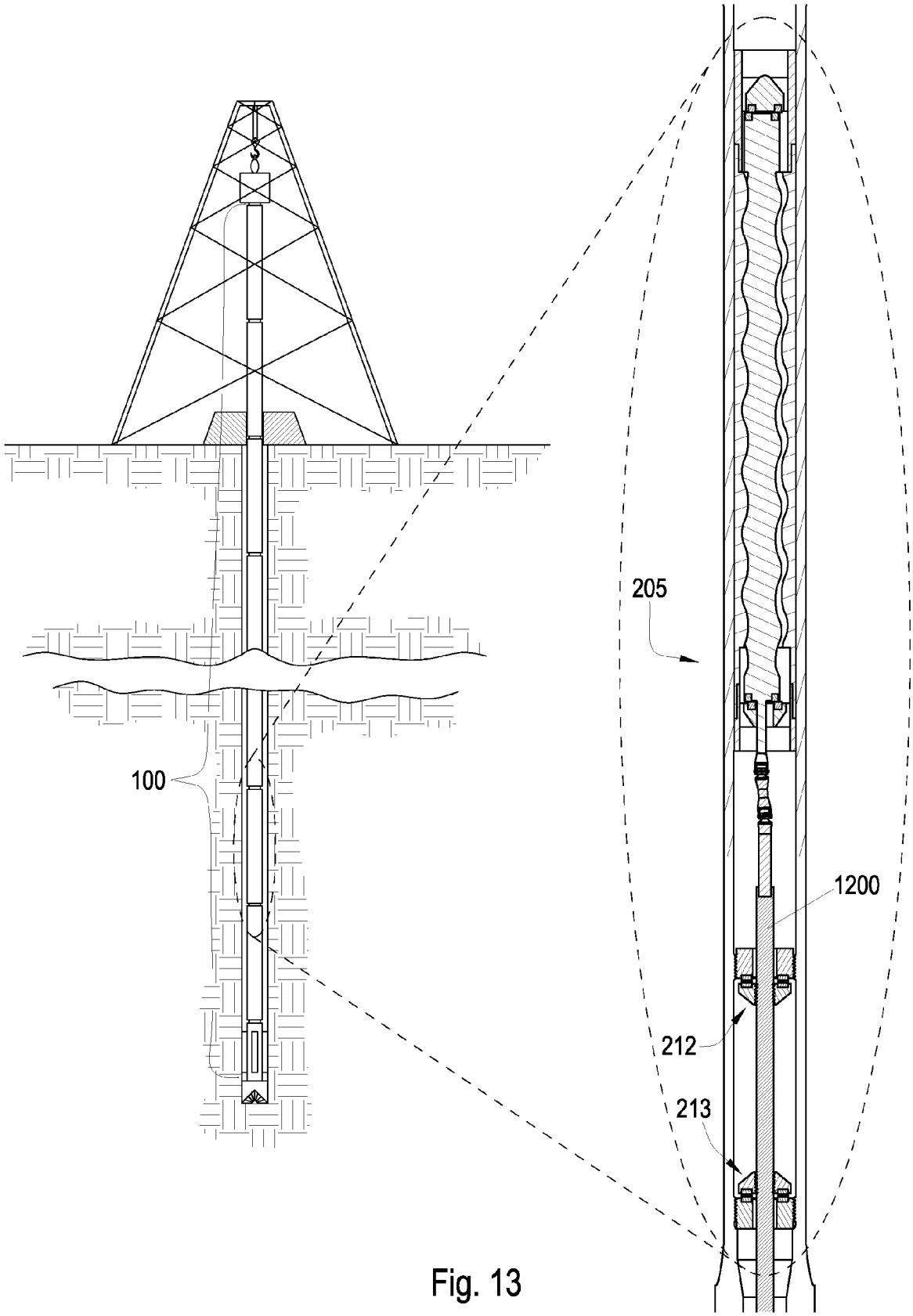
FIG. 13 is a cross-sectional diagram of another embodiment of a drill string suspended in a bore hole.

The shaft 1200, along with the motor and the cam/thrust bearing assemblies 213, 212, may be disposed within a downhole component at any location of a downhole drill string 100, as in FIG. 13. As the shaft 1200 rotates, the portion of drill pipe 205 being stretched causes the pipe to experience a vibrating effect, which may be useful in vibrating the drill string 100 loose if it gets lodged in formations downhole. This may reduce the amount of time and money wasted while the drill string is stuck.

Figure 14:
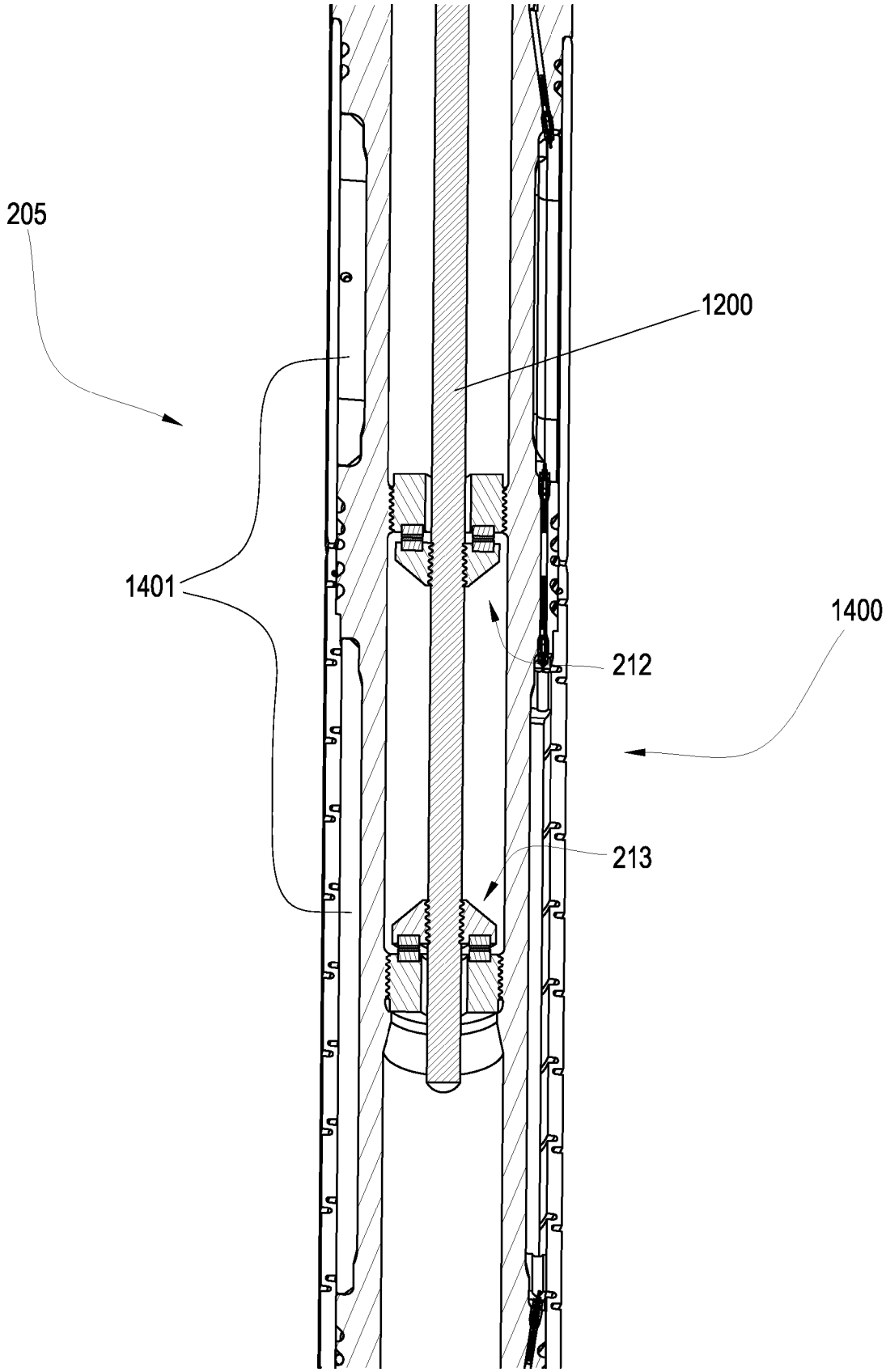
FIG. 14 is a cross-sectional diagram of an embodiment of a drill string component.

Referring now to FIG. 14, elastically changing the length of the drill string component 205 may also be used in conjunction with sensors or electronics, which may be disposed within recesses 1401 protected by a sleeve 1400 around the drill string component 205 or attached to elements within the pipe. The sleeve 1400 may be strong enough to stretch or compress with any elastic change in the length of the drill string component 205 and may protect the sensors and electronics from forces caused by the drill string 100 impacting against the formations. The sensors may be pressure sensors, strain sensors, flow sensors, acoustic sensors, temperature sensors, torque sensors, position sensors, vibration sensors, or any combination thereof. The sensors may be in communication with the electronics and the electronics may use the information in adjusting the speed of the motor or they may transmit the information to the surface to aid drill string operators.

Strain sensors may be used to determine how much tension or compression is in the shaft 1200 or the drill string component 205. Vibration sensors may be used to determine the amount of vibration in the shaft 1200 or downhole component. Temperature sensors may be used to determine the heat produced by the bearings or cam assembly. Flow or pressure sensors may be used to determine the amount of fluid flowing past the motor, thrust bearing assembly 212, or cam assembly 213 and whether or not there is enough pressure to bring materials up from the bottom of the drill string. Torque sensors may be used to determine any amount of torque in the shaft, which may aid in adjusting the rotational speed of the motor or the drill string, or both. Position sensors such as a gyro may be used to determine the position or rotation of the shaft with respect to the downhole component. This information may also be used to regulate the rotational speed of the motor and maintain the shaft substantially stationary with the formation, since the rotational speed of the drill string may not be constant.

Acoustic (or seismic) sensors, such as hydrophones and geophones, may be used to receive complex data about seismic waves caused in the formation by the vibration of the shaft 1200 or the tubular body. The seismic data received by the acoustic sensors may be interpreted on the surface and may provide useful information about the kinds of formations which are immediately in front of the drill string. This may aid in finding oil reserves or anticipate hard formations. The sensors may be placed on the shaft, the drill bit, or at various places along the drill string. In some embodiments, a network may be incorporated in the drill string, so that the information acquired downhole hole may be transmitted uphole. In other embodiments, the information may be sent uphole through electromagnetic waves or through a mud pulse system. The telemetry system of choice is the IntelliServ system, which is in part described in U.S. Pat. No. 6,670,880 and hereby incorporated by reference for all that it discloses.

Figure 15:
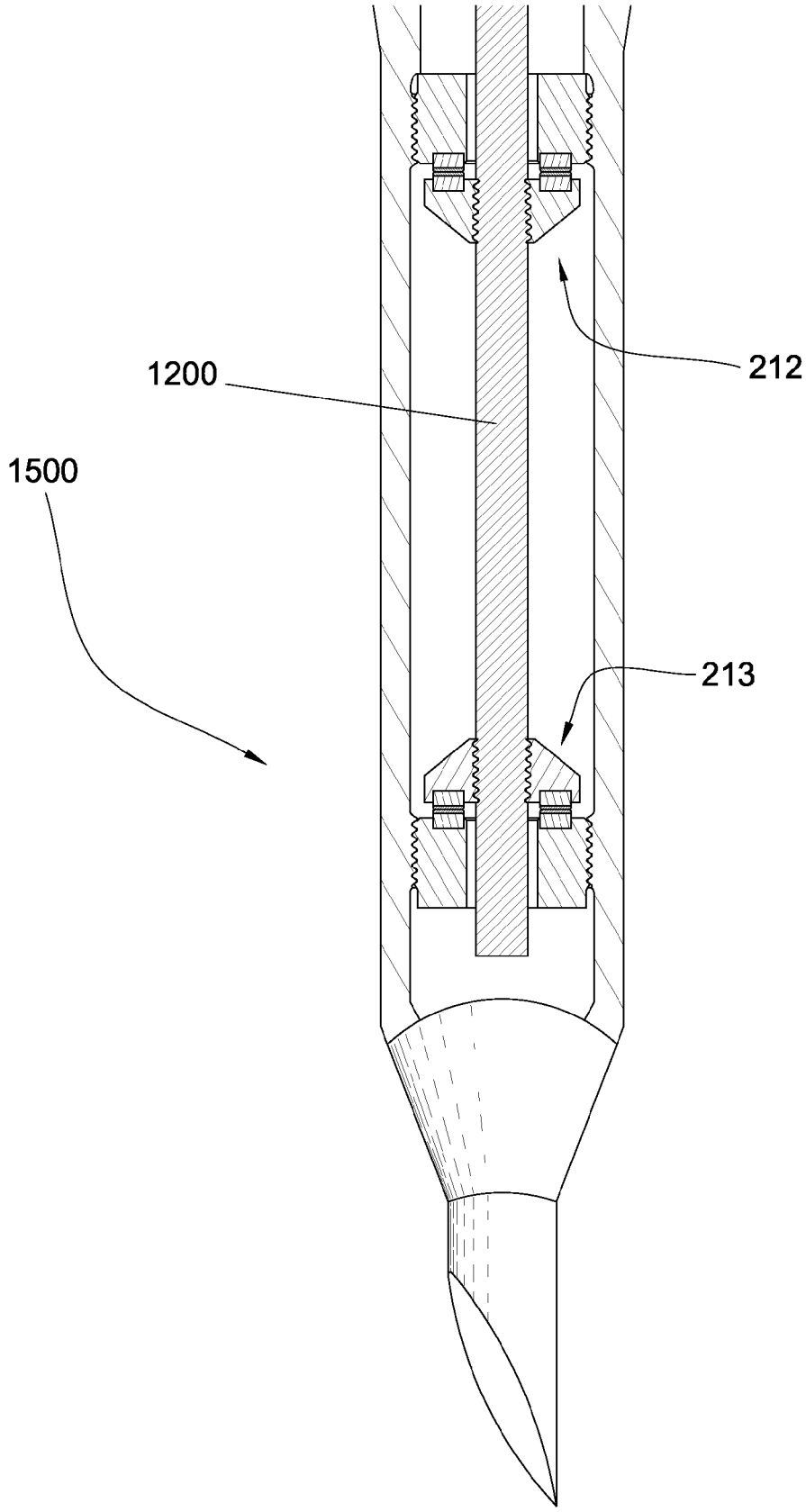
FIG. 15 is a cross-sectional diagram of another embodiment of a drill bit.

The present invention may also be used in horizontal downhole dilling. The downhole component may be a mechanical worm 1500, as in the embodiment of FIG. 15. The cam/thrust bearing assembly 213, 212 may be adapted to elastically change the length of a portion of the mechanical worm 1500, thereby causing the worm 1500 to vibrate. The cam assembly 213 may comprise a sinusoidal surface geometry such that as the shaft 1200 rotates, the mechanical worm 1500 experiences a sinusoidal vibration. The sinusoidal vibration may allow the mechanical worm 1500 to penetrate the formation with said vibration being the primary driving mechanism. The mechanical worm 1500 may be designed such that it is steerable. In some embodiments, anchors—such as arms, rams, or packers—may be used to allow the worm to move in a forward direction and not in a backward direction.

Whereas the present invention has been described in particular relation to the drawings attached hereto, it should be understood that other and further modifications apart from those shown or suggested herein, may be made within the scope and spirit of the present invention.

What is claimed is:

1. A downhole drill string component, comprising:

a shaft being axially fixed at a first location within an axial bore of the component;

a mechanism for elastically changing a length of at least a portion of the wall of the bore, the mechanism being axially fixed at a second location within the bore, the mechanism comprises a thrust bearing substantially coaxial with a cam disposed around the shaft, and the mechanism being in communication with a power source, wherein, when the mechanism is energized by the power source and the length of the wall is lengthens, the shaft shortens.

2. The component of claim 1, wherein the downhole component comprises sensors.

3. The component of claim 1, wherein the downhole component is selected from the group consisting of drill pipes, production pipes, heavyweight pipes, reamers, bottom-hole assembly components, jars, swivels, drill bits, and subs.

4. The component of claim 1, wherein the first and second locations are at least 1 foot apart.

5. The component of claim 1, wherein the first and second locations are proximate opposite ends of the shaft.

6. The component of claim 1, wherein the mechanism comprises a surface with a hardness greater than 63 HRc.

7. The component of claim 6, wherein the surface comprises a material selected from the group consisting of chromium, tungsten, tantalum, niobium, titanium, molybdenum, carbide, cubic boron nitride, TiN, AlNi, AlTiNi, TiAlN, CrN/CrC/(Mo, W)S2, TIN/TiCN, AlTiN/MoS2, TiAlN, ZrN, whisker reinforced ceramics, natural diamond, synthetic diamond, polycrystalline diamond, vapor deposited diamond, layered diamond, infiltrated diamond, thermally stable diamond, diamond impregnated carbide, diamond impregnated matrix, silicon bonded diamond, cobalt bonded diamond, polished diamond, and combinations thereof.

8. The component of claim 1, wherein the cam comprises teeth that are stepped, jagged, smooth, unequal, asymmetrical, parabolic, domed, conical, rounded, semispherical, or combinations thereof.

9. The component of claim 1, wherein the mechanism comprises a polished finish.

10. The component of claim 1, wherein the shaft extends beyond a face of a drill bit.

11. The component of claim 1, wherein the shaft extends into an opening of an adjacent second downhole drill string component.

12. The component of claim 1, wherein the thrust bearing comprises a finish surface with a hardness greater than 63 HRc.

13. The component of claim 1, wherein a portion of the shaft is adapted to rotate within the bore of the component.

14. The component of claim 1, wherein the power source is a motor or a turbine.

15. A downhole drill string component, comprising:

a shaft being axially fixed at a first location within a bore of the component;

a cam assembly for elastically changing a length of at least a portion of the wall of the bore of the component, the cam assembly being axially fixed at a second location within the bore, and the cam assembly being in communication with a power source, wherein, when the cam assembly is rotated, the length of the wall is elastically changed.

16. A method for changing a length of at least a portion of a downhole component, comprising the steps of:

providing a shaft axially fixed at a first location within an bore of the component;

providing a linear actuator for elastically changing the length of a wall of a bore of the component, the linear actuator being axially fixed at a second location within the bore;

providing a power source in communication with the linear actuator; and elastically changing the length by powering the linear actuator.

17. The method of claim 16, wherein the length is elastically changed by 0.001 to 0.01 inches.

* * * * *